United States Patent [19]

Chu

[11] 4,356,535

[45] Oct. 26, 1982

[54] MODERN FAN DEVICE

[76] Inventor: Chung S. Chu, No. 2, La. 9, Tan Shain Rd., Pan Chaiu City, Taipei, Taiwan

[21] Appl. No.: 187,940

[22] Filed: Sep. 17, 1980

[51] Int. Cl.[3] ..... F21V 21/30

[52] U.S. Cl. ..... 362/35; 362/216; 362/294; 362/311; 362/269; 362/319; 362/363; 362/373

[58] Field of Search ..... 362/35, 216, 294, 311, 362/269, 319, 363, 373

[56] References Cited

U.S. PATENT DOCUMENTS 3,180,981 4/1965 Ulffers ..... 362/294

4,214,296 7/1980 Magett ..... 362/806

*Primary Examiner*—Stephen J. Lechert, Jr.

*Attorney, Agent, or Firm*—Karl W. Flocks; A. Fred Starobin

[57] ABSTRACT

The present invention is to provide a latest modern fan device and, more particularly, to a fan device with novel simple construction which may be hung under ceiling for being used as fan and lamp.

4 Claims, 5 Drawing Figures

MODERN FAN DEVICE

BACKGROUND OF THE INVENTION

The present invention is to provide a latest modern fan device and, particularly, to a fan device with novel simple construction which may be hung under ceiling.

Heretofore, the present electric fan and the pendent lamp, both hanging under ceiling, are installed under ceiling in separate. They will therefore occupy more space in the room and will always increase much troubles while in installation due to the limitation of space. For example, if choosing the most proper position for installing the pendent lamp, the illuminating effect could come up to the expections but the pendent fan will therefore not be able to be set at the above said position to affect the effect of faning. From above described, it will be understood that locking after both sides is rather difficult.

Furthermore, most of the general pendent fans can't rotate angularly so faning the air will be limited out of practical use. Even install a conventional angular rotating device on the electric fan, the faning effect is still in bad condition because the scope of faning the air will change following the turning change of fan causing the wind off and on.

The present invention is to overcome above defects with respect to the installation and utilization of the Pendent fan and pendent lamp, and to provide a modern fan device which is born with novel simple construction and can certainly improve some achievements.

SUMMARY OF THE INVENTION

In accordance with the present invention, the modern fan device comprises:

- a shell body;
- a first motor fixed at upper part of shell body and a fan-leaf rotating by means of said first motor;
- a second motor fixed at lower part of shell body;
- a shade, covering over the opening of the shell body, which may rotate by means of said second motor and is provided with multiple continuous netted air holes;
- an illuminating lamp annularly fixed between the fan-leaf and the transparent shade.

Therefore, the primary object of the present invention is to disclose a modern fan device and, particularly, to a latest fan device in which fan and lamp may be integrately collected together to minimize installation space.

The other object of the present invention is to provide a modern fan device and, particularly, to install the fan and lamp together that will completely produce functions of fan and lamp.

Another object of the present invention is to provide a modern fan device, in which the shade is provided with multiple continuous radiate air holes so that the wind from the fan-leaf may radiately blow out through air holes of the transparent shade, reaching to every room-corner.

A further object of the present invention is to provide a modern fan device, in which the shade may rotate under driving of the second motor to change directions of the air holes and wind and, besides, to strengthen exhaust of the wind.

DETAILED DESCRIPTION

Figure 1:
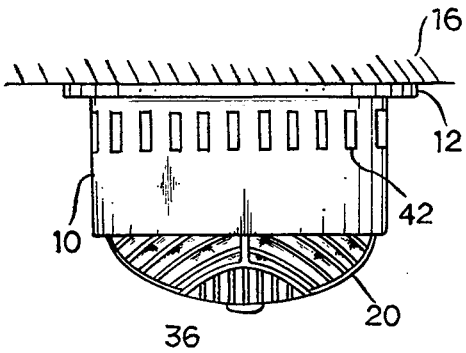
FIG. 1 is a front view of the modern fan device of this invention.
Figure 2:
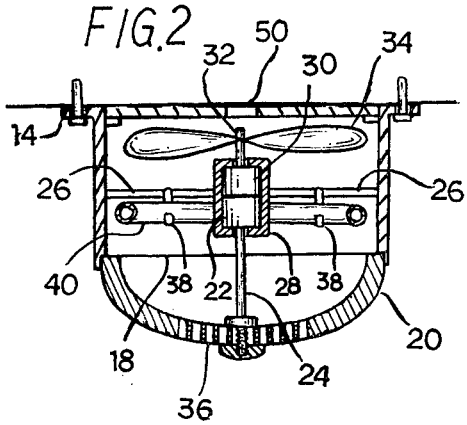
FIG. 2 is a longitudinally sectional view of the modern fan device of this invention.
Figure 3:
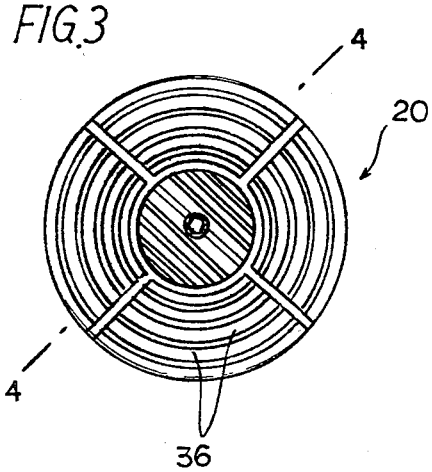
FIG. 3 is a plane view of the shade.

Referring to FIGS. 1 and 2, the modern fan device of the invention comprises a shell body 10, one end of which is formed to be as a fixed base 12 having nailing pores 14 to be nailed by nails so as to mount the shell body 10 on ceiling 16. The other end of the shell body 10 is made to be as an opening 18 covered with a hemisphered shade 20 with fine diaphanous quality that is rotably fixed on the front end of the turning axle 24 of the second motor 22 and may rotate under driving of said turning axle 24. In the inner side, the shell body 10 is provided with three supporting ribs 26 in order to steadily hold a motor case 28.

The second motor 22 is to be set at lower part of the motor case 28 and the first motor 30 set at upper part of the motor case 28. The turning axle 32 of said first motor 30 is mounted with a fan-leaf 34 faning the air to the opening 18 of the shell body 10. Upon turning on the switch of the first motor 30 to drive the turning axle 32 to rotate the fan-leaf 34, the wind from the fan-leaf 34 to the shade 20 will radiately blow out through radiate air holes 36 of the shade 20 reaching to every room-corner. If desirous to rotate the shade 20, the switch of said second motor 22 can be turned on for rotating the shade 20 to change directions of the air holes 36 and the wind and, besides, to strengthen exhaust of the wind.

Now specifically referring to FIG. 2, in accordance with the modern fan device of the present invention, a lamp hook 38 is respectively provided on the mentioned three supporting ribs 26 for supporting an annular fluorescent lamp 40. Due to the fluorescent lamp 40 being placed between the fan-leaf 34 and the transparent shade 20, the light will directly pass through the shade 20 without affecting lamp illumination resulted from the light being shielded by fan-leaf 34. The indicated number 50 shown in FIG. 2 shows an electric wire hole 50.

The modern fan device of the present invention possesses a characteristic that lamp and fan may be integrately collected together; thus it will be convenient for installation without the worry about occupying more space, and the fan and the lamp can be used individually or used together. Furthermore, the fan and the motor in accordance with the invention are placed within the shell body 10 similar to the conventional used lamp's shell body so it locks like a lamp viewed from its outer appearance, giving people a special taste and aesthetic sense.

Figure 4:
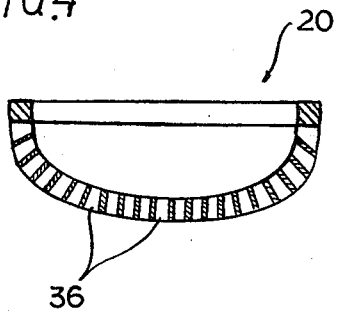
FIG. 4 is a longitudinal view taken along the line 4—4 of FIG. 3.
Figure 5:
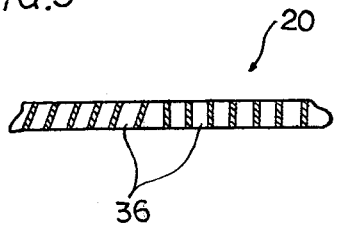
FIG. 5 is a longitudinally sectional view of the shade taken from another example.

Besides, the air holes 36 of the shade 20 may be schemed to various specifications, such as radiate air holes as shown in FIG. 4 and the air holes shown in FIG. 5. In FIG. 5, the air holes at right side face down vertically and the air holes at left side face out slantly, so the wind exhausted from air holes will spread over every room-corner as the shade 20 rotates under driving of the second motor 22.

I claim:

1. A modern fan device comprising a shell body;

a first motor having a turning axle and a fan leaf mounted on said turning axle of said first motor;

said first motor and said fan leaf positioned at the upper part of said shell body with said fan leaf driven by said first motor to fan air out of said shell body;

a second motor positioned at a lower part of said shell body;

a light penetrating shade covering over an opening in said shell body connected for rotation by said second motor;

and an annular illuminating lamp supported between said fan leaf and said shade.

2. A modern fan device as claimed in claim 1, wherein the shade is made from the material with fine diaphanous quality.

3. A modern fan device as claimed in claim 1, wherein the shade is provided with multiple continuous air holes.

4. A modern fan device as claimed in claim 1 and claim 3, wherein the multiple continuous air holes on the shade are given various directions in such a manner as to guide the wind blowing out along various directions.

* * * * *